United States Patent [19]

Schneider et al.

[11] Patent Number: 4,867,111

[45] Date of Patent: Sep. 19, 1989

[54] ARRANGEMENT FOR THE ACTUATION OF A GAS-EXCHANGE DISK VALVE

[75] Inventors: Klaus Schneider, Tiefenbronn-Muehlhausen; Hans-Joachim Esch, Heimsheim; Van-Khanh Tran, Weissach, all of Fed. Rep. of Germany

[73] Assignee: Dr. Ing. h.c.F. Porsche AG, Fed. Rep. of Germany

[21] Appl. No.: 274,909

[22] Filed: Nov. 22, 1988

[30] Foreign Application Priority Data

Nov. 25, 1987 [DE] Fed. Rep. of Germany ..... 3739891

[51] Int. Cl.[4] ..... F01L 1/16; F01L 9/04

[52] U.S. Cl. ..... 123/90.11; 123/90.49

[58] Field of Search ..... 123/90.11, 90.12, 90.24, 123/90.49

[56] References Cited

U.S. PATENT DOCUMENTS

| | | | |
|---|---|---|---|
| 4,515,343 | 5/1985 | Pischinger et al. | 123/90.11 |
| 4,614,170 | 9/1986 | Pischinger et al. | 123/90.11 |
| 4,715,332 | 12/1987 | Kreuter | 123/90.11 |
| 4,762,095 | 8/1988 | Mezger et al. | 123/90.11 |
| 4,777,915 | 10/1988 | Bonvallet | 123/90.11 |

FOREIGN PATENT DOCUMENTS

| | | |
|---|---|---|
| 0118591 | 8/1983 | Fed. Rep. of Germany . |
| 3616540 | 5/1986 | Fed. Rep. of Germany . |
| 0242228 | 4/1987 | Fed. Rep. of Germany . |
| 293141 | 4/1903 | France . |

*Primary Examiner*—Charles J. Myhre
*Assistant Examiner*—Weilun Lo
*Attorney, Agent, or Firm*—Barnes & Thornburg

[57] ABSTRACT

An arrangement for the actuation of a gas-exchange disk valve longitudinally guided in the cylinder head of a reciprocating piston which is opened and closed against spring force by two alternately periodically energized electromagnets. An armature coaxial to the disk valve together with an armature disk secured at the same is thereby moved to and fro and stresses a cylindrical torsion rod spring clamped-in at the cylinder head by way of a valve lever pivotally connected at the armature. For compensating manufacturing tolerances and thermal expansion, a magnetizable entrainment disk is arranged in the armature disk with axial play which is threadably connected with the stem end of the disk valve and effects the tight closing thereof.

18 Claims, 2 Drawing Sheets

ARRANGEMENT FOR THE ACTUATION OF A GAS-EXCHANGE DISK VALVE

BACKGROUND AND SUMMARY OF THE INVENTION

The present invention relates to an arrangement for the actuation of a gas-exchange disk or poppet valve longitudinally guided in the cylinder head of a reciprocating piston engine with two electromagnets which are alternately periodically energized and thereby move to and fro an armature against the force of a cylindrical torsion rod spring that opens and closes the disk valve.

Such an actuating arrangement is described in the patent application No. P 36 16 540.9-13. The gas-exchange valve is actuated by two electromagnets operating against a spring force which are alternately energized and thereby move the armature to and fro which opens and closes the disk valve. In order to keep small the moved spring masses and therewith the mass inertia of the entire actuating arrangement, a cylindrical torsion rod spring is used as spring. The torsion rod spring is non-rotatably connected at its one side at the cylinder head and at its other side with one end of a one-armed valve lever. With its other end, the valve lever pivotally engages at the valve stem of the disk valve. At a distance from this pivotal connection, the armature is attached at the valve lever. As two pivotal connecting places are present, which are always beset by manufacturing tolerances, it is difficult to so match the actual valve stroke to the armature stroke that, on the one hand, the valve is tightly closed and, on the other, no excessively large air gap remains between the armature disk and the electromagnet in the closing position.

It is the object of the present invention to so further develop such an actuating mechanism in such a manner that its moved masses are once more reduced and the function of the valve operation is assured without maintaining very narrow manufacturing tolerances.

The underlying problems are solved according to the present invention in that the valve lever is pivotally connected at its free end with the armature and in that the armature together with the armature disk concentrically secured thereat is arranged coaxially to the stem of the disk valve. If the armature together with the armature disk is disposed coaxially to the disk valve, the disk valve can be controlled by means of the armature during the energization of the electromagnets without interconnection of pivotal connecting places inherently having play. An exact coordination between armature stroke and valve stroke then exists insofar as the manufacturing tolerances of the disk valve and armature as well as the spacing tolerance from the seat of the disk valve to the end surfaces of the electromagnets are maintained.

In order to become even more independent of manufacturing tolerances and to create a stress-free compensation in case of thermal expansion of the disk valve, according to another feature of the present invention a magnetizable entrainment disk is secured at the stem end of the disk valve which is disposed with axial play between two abutment surfaces of the armature disk. The construction becomes simplest if the armature disk is formed of two circular disks and the entrainment disk is placed into the separating plane thereof with axial play relative to the end surfaces of the disks which now serve as abutment surfaces. If during the closing of the disk valve the armature disk is attracted and placed against the upper electromagnet, then the entrainment disk is subsequently pulled upwardly by the electromagnet until the disk valve closes tightly. For purposes of opening the disk valve, the upper electromagnet is de-energized and the armature disk is displaced downwardly by spring force.

The construction according to the present invention makes it possible to integrate in the simplest manner also a hydraulic damping arrangement into the actuating mechanism which prevents a hard and noisy contact of the valve disk and undesired oscillatory movements. For that purpose, the armature is provided with a central bore filled with a hydraulic liquid. A piston acting on the stem end of the disk valve is longitudinally movably guided in the central bore and in the armature disk; the piston is supported by a coil spring which abuts at a radial projection of the central bore. The central bore is provided with a ball check valve above the radial projection. The construction according to the present invention makes it possible to construct the valve lever shorter with the same valve stroke to be realized.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figure 1:
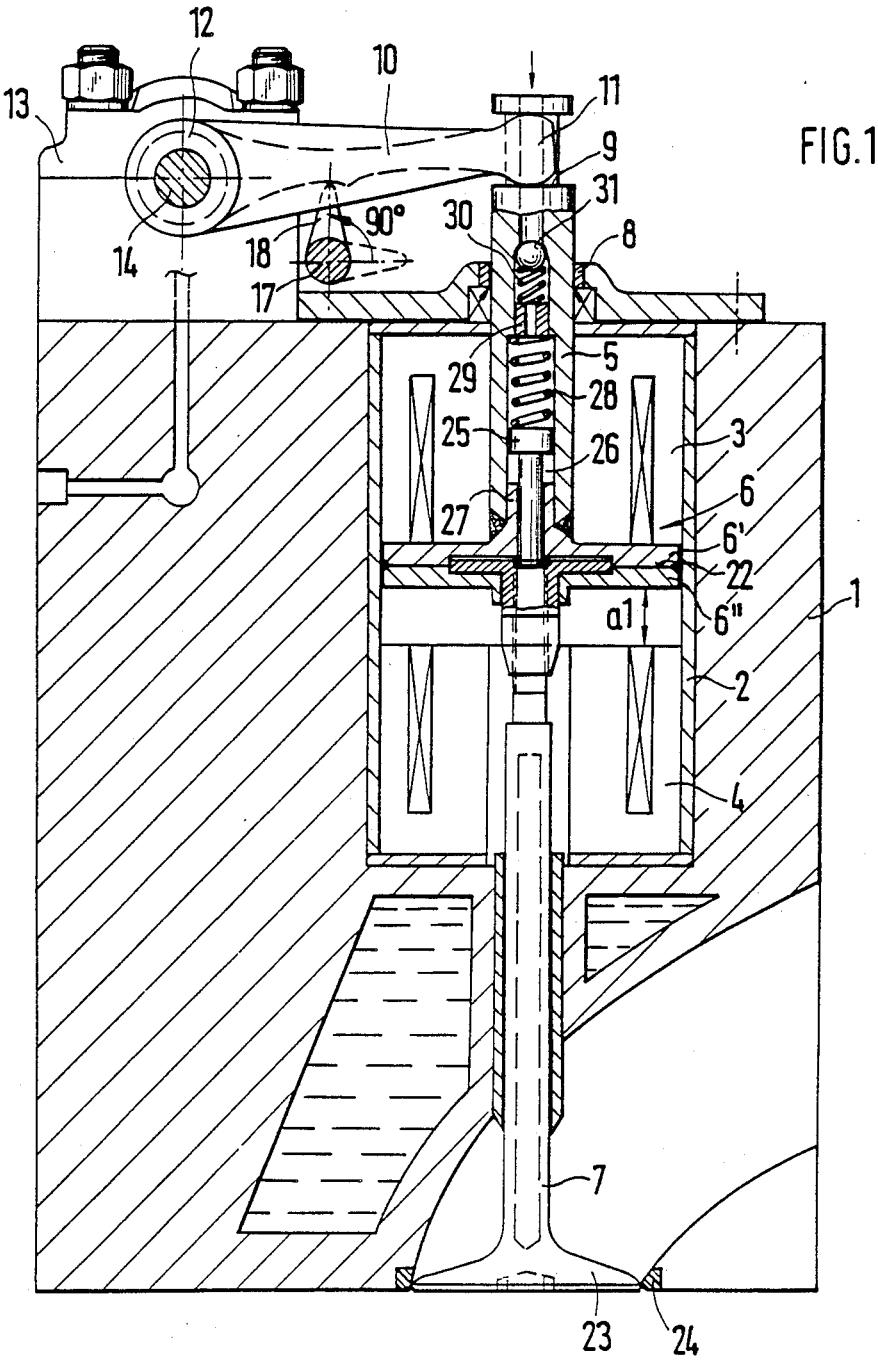
FIG. 1 is a longitudinal cross-sectional view through the valve control according to the present invention.

Referring now to the drawing wherein like reference numerals are used throughout the various views to designate like parts, a magnet housing 2 is secured at the cylinder head 1 of a reciprocating piston engine, in which a first electromagnet 3 and a second electromagnet 4 are fixedly mounted with a distance a1 to one another. An armature disk 6 secured at an armature 5 is disposed in the free space between the electromagnets 3 and 4 which is retained in the end position by the respectively energized electromagnet 3 or 4.

The armature 5 is sealed off in the magnet housing 2 and is longitudinally movably guided in a bearing 8. At its end protruding out of the magnet housing 2, the armature 5 is provided with a recess 9 into which engages a fork 11 attached at the end of a valve lever 10. At its other end, the valve lever 10 is constructed as tubular bearing member 12. The tubular bearing member 12 is supported in a bearing block 13 threadably secured at the cylinder head 1. The tubular bearing member 12, respectively, the valve lever 10 is secured against axial displacement by end-face abutment at the bearing block 13.

Figure 2:
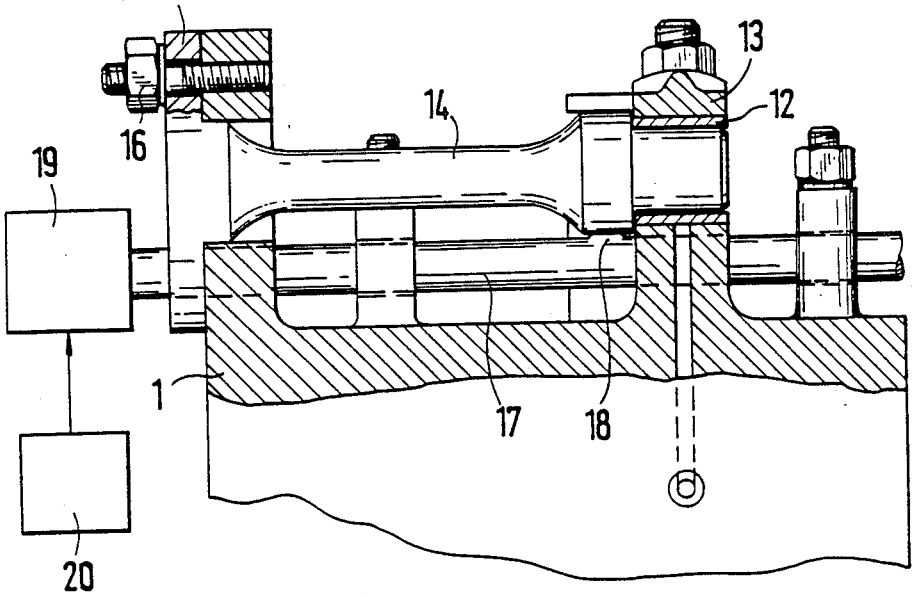
FIG. 2 is an elevational view, partly broken away, of the torsion rod spring and its bearing support in accordance with the present invention.

Within the area of the bearing block 13, the one end of a cylindrical torsion rod spring 14 is secured in the tubular bearing member 12. The other end of the torsion rod spring 14 is provided with a flange 15 (FIG. 2) and is threadably secured at the cylinder head 1 by means of bolts 16.

A cam shaft 17 is supported in the cylinder head 1 underneath the valve lever 10 parallel to the torsion rod spring 14 whose holding cams 18 are pivoted up during standstill of the engine and thus block the valve lever 10 and stresses the torsion rod spring 14. A stepping motor 19 (FIG. 2) serves for pivoting the cam shaft 10 which is activated by a control apparatus 20 in dependence on sensor signals of the engine.

Figure 3:
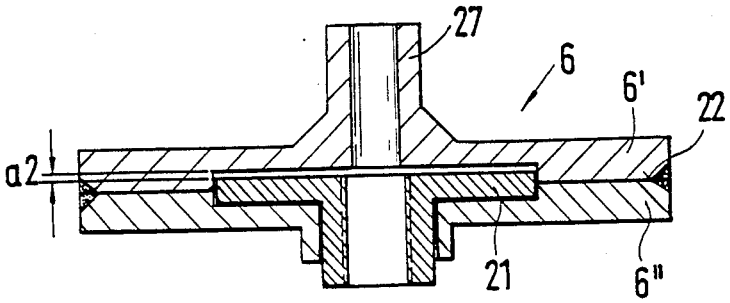
FIG. 3 is a cross-sectional view through the armature disk, on an enlarged scale.

An entrainment disk 21 (FIG. 3) is threadably secured to the stem end of the valve disk 7 which is inserted in the separating plane 22 between the upper part 6' and the lower part 6" of the armature disk 6. After the insertion of the entrainment disk 21, the two parts 6' and 6" are welded together. The entrainment disk 21, like the armature disk 6, is made of magnetizable material. As can be seen from FIG. 3, it has a spacing a2 with respect to the upper part 6' of the armature disk 6.

For purposes of closing the disk valve 7, the armature disk 6, after de-energization of the electromagnet 4, is placed by the torsion rod spring 14 against the end face of the electromagnet 3. Thereafter, this electromagnet 3 attracts the entrainment disk 21 and displaces the same toward the upper part 6' of the armature disk 6; the disk 23 is thereby placed tightly against the seat ring 24. For purposes of opening the disk valve 7, the armature disk 6 is again initially displaced as a whole toward the lower electromagnet 4 and thereafter the entrainment disk 21 is displaced relative thereto. The torsion rod spring 14 is so rotated through the same angular travel during the opening and closing of the disk valve 7 that its force-displacement curve is linear in both directions about the neutral zero position. Additionally, this spring return and energy storage by means of the torsion rod spring 14 operates completely without play in a desired manner.

In order to dampen the impact during the closing of the disk 23 on the seating ring 24, the armature 5 includes a hydraulic damping arrangement acting on the stem end of the disk valve 7. The damping arrangement consists of a piston 25 which is longitudinally guided in an oil-filled central bore 26 of the armature 5 and in a pin 27 of the armature disk 6 fitted into the central bore 26. The piston 25 is damped by the hydraulic oil and is stressed by a coil spring 28 which is supported at a radial projection 29 of the central bore 26. A further coil spring 30 and a valve ball 31 abutting at a seat of the central bore 26 is arranged on the other side of the radial projection 29 as springy check valve. The arrangement of the entrainment disk 21 and the damping arrangement disposed centrally in the armature 5 according to the present invention can also be utilized for an electromagnetic valve actuation in which in lieu of a torsion rod spring two coil springs are used for the energy storage.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An arrangement for actuating a gas-exchange disk valve longitudinally guided in the cylinder head of a reciprocating piston engine, comprising two electromagnet means which are alternately periodically energized and are operable to move to and fro an armature means against the force of a cylindrical torsion rod spring means, which is operable to open and close the disk valve, the torsion rod spring means being non-rotatably retained at its one side at the cylinder head and being non-rotatably connected at its other side with a one-armed valve lever that is pivotally connected with the armature means, the valve lever being pivotally connected to the armature means at its free end and the armature means together with an armature disk means concentrically secured at the same being arranged substantially coaxially to the stem of the disk valve.

2. An arrangement according to claim 1, wherein a magnetizable entrainment disk is secured at the stem end of the disk valve, which is longitudinally movably so arranged with axial play at the armature disk means that it can be alternately attracted by the electromagnet means.

3. An arrangement according to claim 2, wherein the armature disk means is composed of two approximately equally large parts abutting at one another in a separating plane and wherein the entrainment disk is arranged in the separating plane.

4. An arrangement according to claim 1, wherein a central bore provided in the armature means which is filled with a hydraulic fluid accommodates a hydraulic damping means acting on the stem end of the disk valve.

5. An arrangement according to claim 4, wherein the hydraulic damping means includes a piston which is longitudinally guided in the central bore and abuts end-face at the stem end of the disk valve, and a coil spring stressing the piston at its other end and supported at a radial projection of the central bore.

6. An arrangement according to claim 5, wherein a second coil spring is supported on the other side of the radial projection which presses a valve ball against a valve seat formed in the central bore.

7. An arrangement according to claim 1, wherein a rotatable blocking cam means is provided underneath the valve lever approximately centrally with respect to its arm length which, after turn-off of the engine, supports the valve lever and thus holds the disk valve in the closed position.

8. An arrangement according to claim 2, wherein the armature means is made of non-magnetizable material while the armature disk means and entrainment disk are made of readily magnetizable material.

9. An arrangement according to claim 8, wherein the armature disk means is fitted by means of a pin into the central bore of the armature means and is connected with the pin by bonding, welding or threaded connection.

10. An arrangement according to claim 5, wherein a magnetizable entrainment disk is secured at the stem end of the disk valve, which is longitudinally movably so arranged with axial play at the armature disk means that it can be alternately attracted by the electromagnet means.

11. An arrangement according to claim 10, wherein the armature disk is composed of two approximately equally large parts abutting at one another in a separating plane and wherein the entrainment disk is arranged in the separating plane.

12. An arrangement according to claim 10, wherein a rotatable blocking cam means is provided underneath the valve lever approximately centrally with respect to its arm length which, after turn-off of the engine, supports the valve lever and thus holds the disk valve in the closed position.

13. An arrangement according to claim 10, wherein the armature means is made of non-magnetizable material while the armature disk means and entrainment disk are made of readily magnetizable material.

14. An arrangement according to claim 13, wherein the armature disk means is fitted by means of a pin into the central bore of the armature means and is connected with the pin by bonding, welding or threaded connection.

15. An arrangement according to claim 10, wherein a second coil spring is supported on the other side of the radial projection which presses a valve ball against a valve seat formed in the central bore.

16. An arrangement for actuating a gas-exchange disk valve longitudinally guided in the cylinder head of a reciprocating piston engine, comprising two electromagnet means which are alternately periodically energized and are operable to move to and fro an armature means against the force of a spring means, which is operable to open and close the disk valve, a one-armed valve lever that is pivotally connected with the armature means, the armature means together with an armature disk means concentrically secured at the same being arranged substantially coaxially to the stem of the disk valve, and the armature means being provided with a central bore filled with a hydraulic medium and accommodating a hydraulic damping means acting on the stem end of the disk valve.

17. An arrangement according to claim 16, wherein the hydraulic damping means includes a piston which is longitudinally guided in the central bore and abuts endface at the stem end of the disk valve, and a coil spring stressing the piston at its other end and supported at a radial projection of the central bore.

18. An arrangement according to claim 17, wherein a second coil spring is supported on the other side of the radial projection which presses a valve ball against a valve seat formed in the central bore.

* * * * *